US010827563B2

(12) United States Patent
Siek

(10) Patent No.: US 10,827,563 B2
(45) Date of Patent: Nov. 3, 2020

(54) HEATER CONTROL SYSTEM

(71) Applicant: VTS SPOLKA Z OGRANICZONA ODPOWIEDZIALNOSCIA, Gdansk (PL)

(72) Inventor: Tadeusz Siek, Suchy Dwor (PL)

(73) Assignee: VTS SPOLKA Z OGRANICZONA ODPOWIEDZIALNOSCIA, Gdansk (PL)

( * ) Notice: Subject to any disclaimer, the term of this patent is extended or adjusted under 35 U.S.C. 154(b) by 270 days.

(21) Appl. No.: 15/745,336

(22) PCT Filed: Apr. 14, 2016

(86) PCT No.: PCT/PL2016/050012
§ 371 (c)(1),
(2) Date: Jan. 16, 2018

(87) PCT Pub. No.: WO2017/010898
PCT Pub. Date: Jan. 19, 2017

(65) Prior Publication Data

US 2018/0213601 A1 Jul. 26, 2018

(30) Foreign Application Priority Data

Jul. 14, 2015 (PL) ..... 413127

(51) Int. Cl.
*H05B 1/02* (2006.01)

(52) U.S. Cl.
CPC ..... *H05B 1/028* (2013.01)

(58) Field of Classification Search
CPC ..... H05B 1/028; E01C 11/265
USPC ..... 219/497
See application file for complete search history.

(56) References Cited

U.S. PATENT DOCUMENTS 6,080,971 A * 6/2000 Seitz ..... F24H 9/2028 219/483
2002/0096511 A1* 7/2002 Tsumanuma ..... E01C 11/265 219/501

* cited by examiner

*Primary Examiner* — Jennifer C Chiang
(74) *Attorney, Agent, or Firm* — Adler Pollock & Sheehan P.C

(57) ABSTRACT

A heater control system having an electric heating elements powered from a three-phase alternating current source through a solid state relays connected to the controller and provided with the safety switch assembly is characterized in that each of the heating elements (G) is connected with a separate proportional control solid state relay (K1, K2 K3) and all the proportional control solid state relays (K1, K2, K3) are connected to the controller (S) through the control signal follower (W).

3 Claims, 2 Drawing Sheets

HEATER CONTROL SYSTEM

CROSS REFERENCE TO RELATED APPLICATIONS

Figure 1:
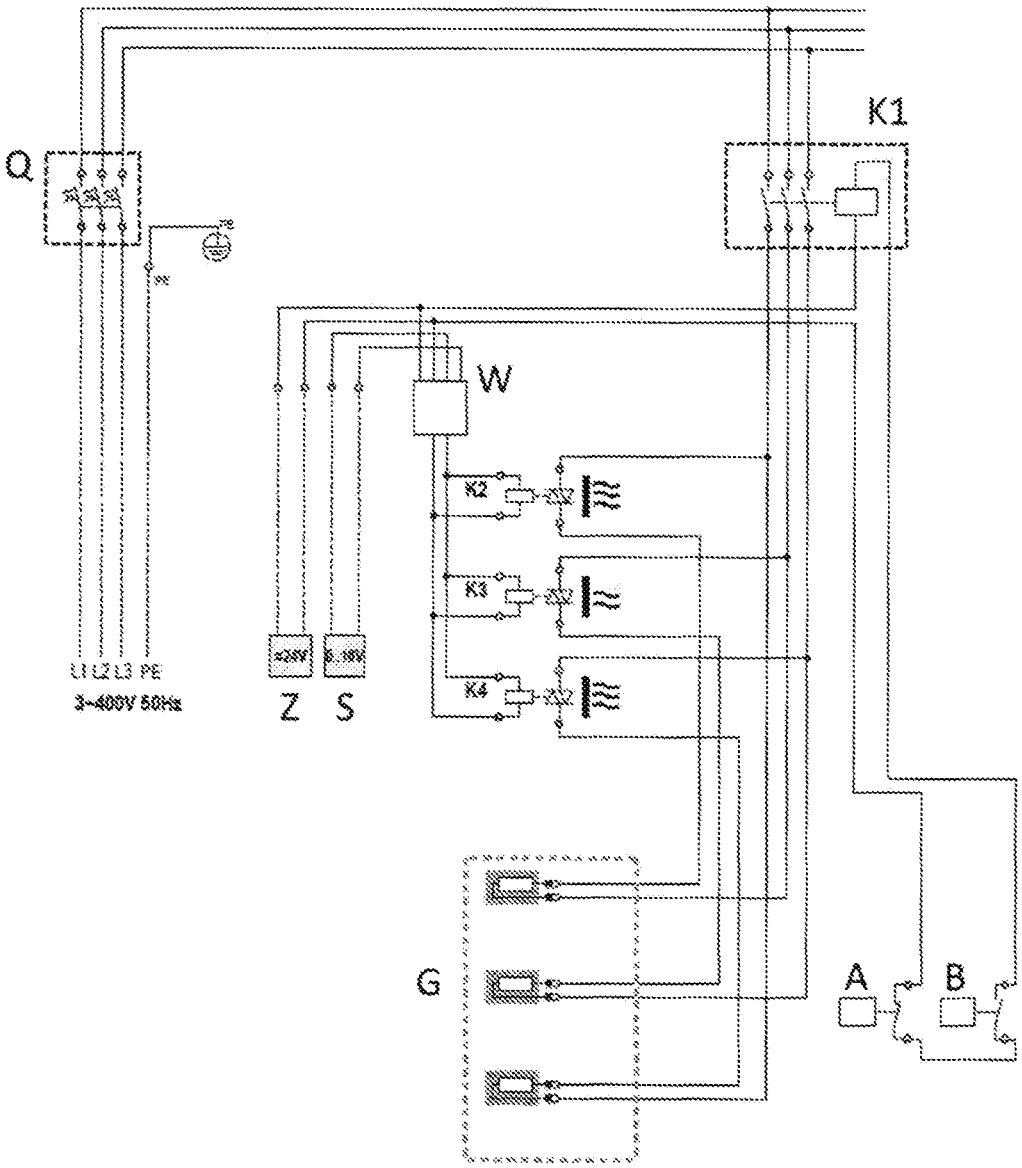

This application is a national phase filing under 35 U.S.C. § 371 of International Application No. PCT/PL2016/050012 filed Apr. 14, 2016, which claims priority from Poland application number P.413127, filed Jul. 14, 2015, the entire contents of which are hereby incorporated by reference herein.

The present invention relates to a heater control system. It is suitable for electric heaters used in ventilation and/or air conditioning systems.

A number of solutions for systems controlling the heating devices in different applications is known. Among them we can mention systems specially adapted for power control of heaters in air handling and air conditioning units. They perform the function of switching on and off electric heaters using solid-state relays which are controlled by a signal from the control system. In known control systems of heaters with two-state solid state relays there is a PWM (Pulse Width Modulation) controller, between the host controller and the relay, which, depending on the signal from the host controller, gives to the relays the appropriate signals controlling heaters time on and off.

Polish patent description PL194636 discloses a system for automatically controlling operation of shaft heaters connected to the electronic device for temperature measurement. It has electromagnetic relays and auxiliary relays in which the controlling coils and the set of contacts are connected in a suitable manner with the contacts of the temperature measuring devices, a timer, a switching on circuit board, a circuit board back-up systems and power circuits.

Patent application US2002/0096511 describes a temperature control apparatus for electric heating equipment. It comprises solid state relays connected between an AC power supply and the electric heating equipment connected with the controller. The controller comprises a processor with data interface and a display, powered by a rectifier circuit with the AC adapter. Analog inputs are connected to the heating elements temperature sensors and the input rectifier circuit. The central processing unit outputs control signals for switching the relays. Solid state relays provide input AC voltage continuously or intermittently by cutting one cycle of waveform from the waveform of the input AC voltage.

European patent application EP2365732A1 describes a system and a method for controlling power applied to a heating element. The system comprises an AC voltage supply, a rectifier to provide adequate voltage, the controller with PWM modulator and the DC voltage modulator to achieve a certain level of voltage and supply the analog voltage to the heating element, based on the pulse-width modulation signal. The system also has a user interface, a temperature sensor, a microcontroller connected to the modulator voltage and a feedback circuit between the modulator voltage and the microcontroller. In this system, the set target temperature is compared with the measured actual temperature and the pulse-width modulation signal is modulated on the base of the temperature comparison result. Next the signal is modulated based on the encoded result of the comparison of the expected and actual value of the DC voltage and the expected DC value encoded in the signal pulse-width modulated is changed, based on the comparison result of temperature and/or voltage comparison result.

The heater control system having an electric heating elements powered from a three-phase alternating current source through a solid state relays connected to the controller and provided with a safety switch assembly according to the invention is characterized in that each of the heating elements is connected to a separate proportional control solid state relay and all of the proportional control solid state relays are connected to the controller through the control signal follower.

The control signal follower is an operational amplifier, the input of which is connected to the analog output of the controller of low amperage, and the output is connected to a control input of each of the three heating elements connected in the symmetric delta configuration.

Preferably the control signal follower is supplied from an external source.

An advantage of the present invention is more effective controlling of the heating elements by using the proportional control solid state relays by one standard industrial controller.

Figure 2:
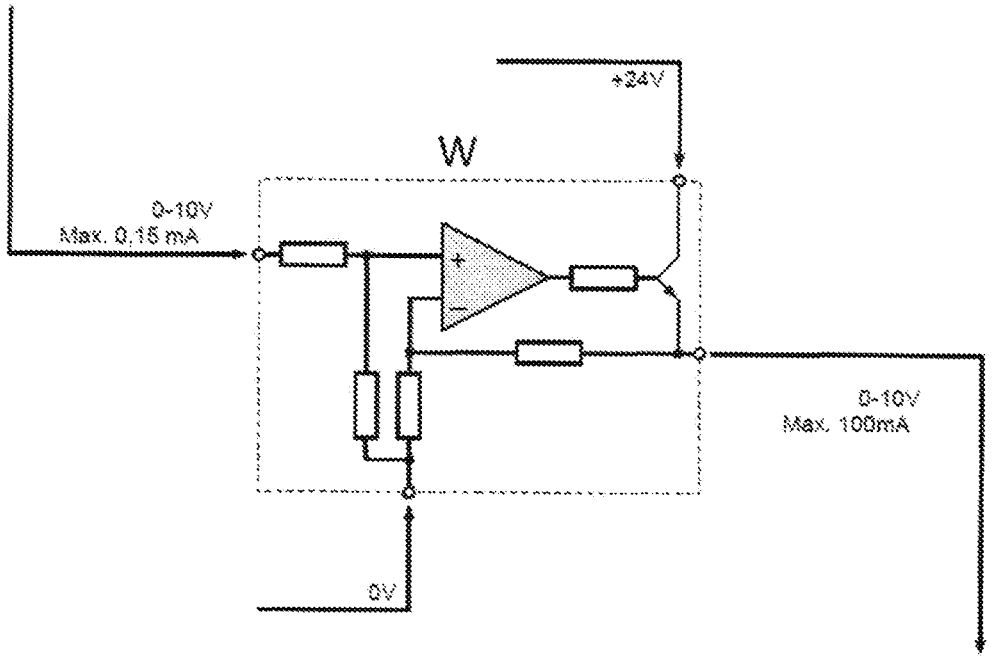

An embodiment of the heater control system according to the invention is illustrated in the drawing, in which FIG. 1 shows a configuration of supply and control, and FIG. 2 shows a configuration of a control signal follower.

In the exemplary embodiment, the heater control system is designed to the ventilation heater having three heating elements G connected in a symmetric delta configuration supplied from the three-phase power system AC 400 V, 50 Hz. The system is equipped with a main switch Q and a safety switch assembly consisting of the electromagnetic contactor K1 combined with thermostat A and pressure switch B. The thermostat A measures the temperature inside the heater—if it exceeds a certain value, the disconnection of power supply occurs. Using a pressure switch B a static pressure fan measurement is implemented—if the fan is not working, the power will not turn on. Each of the three heating elements G is connected to the separate proportional control solid state relay K1, K2, K3. The control input of each of the proportional control solid state relays is connected to the output of the operational amplifier which is a control signal follower W, the input of which is connected to the analog output controller S of a low current efficiency. A control signal follower is 24 V voltage supplied from an external power source Z, in order not to overload the controller. Controller S according to one of the two common industry standards performs the analog output in the range of 0-10 V, low current efficiency. Each of the used proportional control solid state relays K1, K2, K3 requires a control current of 20 mA maximum value. Simultaneous control of three such relays requires a total control current of 60 mA maximum, which creates an excessive burden for a single controller S. A control signal follower W separates the controller S output of the control current load of the proportional control solid state relays K1, K2, K3 and strengthens the control signal being fed from the controller S. The system uses relays which are controlled by current signal 4-20 mA, and the control signal follower W is realized in the form of the operational amplifier in the system providing the input impedance of over 70Ω of the output stage on the bipolar transistor with high current-carrying capacity. An analog signal according to the industry standard 0-10 V, max 1 mA is being fed from the controller S to the input of the control signal follower W, and its output signal is 0-10 V, max 100 mA, providing required for the simultaneous control of the three relays value of the control current in the range of 12-60 mA.

The system according to the invention, by using proportional control solid state relays provides a more effective control of the heater heating elements extending their service life and the use of a control signal follower enables to control this type of relays by a typical industrial controller instead of a separate controller for each relay.

The invention claimed is:

1. A heater control system having an electric heating elements powered from a three-phase alternating current source through a solid state relays connected to a controller and provided with a safety switch assembly wherein each of the heating elements is connected to a separate proportional control solid state relay, and all the proportional control solid state relays are connected to the controller through the control signal follower.

2. The heater control system according to claim 1 wherein the control signal follower is an operational amplifier, the input of which is connected to the analog output of the controller of low amperage, and the output is connected to a control input of each of the three heating elements connected in the symmetric delta configuration.

3. The heater control system according to claim 2 wherein the control signal follower is supplied from an external source.

* * * * *